United States Patent [19]

Anzai

[11] 4,112,893

[45] Sep. 12, 1978

[54] AIR/FUEL RATIO CONTROL SYSTEM FOR INTERNAL COMBUSTION ENGINE HAVING HIGH INPUT IMPEDANCE CIRCUIT

[75] Inventor: Makoto Anzai, Yokosuka, Japan

[73] Assignee: Nissan Motor Company, Limited, Yokohama, Japan

[21] Appl. No.: 749,909

[22] Filed: Dec. 13, 1976

[30] Foreign Application Priority Data

Dec. 25, 1975 [JP] Japan ..... 50/174440[U]

[51] Int. Cl.[2] ..... F02M 7/00

[52] U.S. Cl. ..... 123/119 EC; 123/32 EE; 73/23; 204/195 S

[58] Field of Search ..... 123/119 EC, 32 EE; 60/276, 285; 73/23; 204/195 S, 1 S

[56] References Cited

U.S. PATENT DOCUMENTS

| | | | |
|---|---|---|---|
| 3,827,237 | 8/1974 | Linder et al. | 123/119 EC |
| 3,915,135 | 10/1975 | Kushida et al. | 123/119 EC |
| 3,916,170 | 10/1975 | Norimatsu et al. | 123/32 EE |
| 3,923,016 | 12/1975 | Hoshi | 123/32 EE |
| 3,948,081 | 4/1976 | Wessel et al. | 73/23 |
| 3,949,551 | 4/1976 | Eichler et al. | 123/32 EE |
| 3,990,411 | 11/1976 | Oberstadt et al. | 60/276 |

*Primary Examiner*—Charles J. Myhre
*Assistant Examiner*—Andrew M. Dolinar
*Attorney, Agent, or Firm*—Lane, Aitken, Dunner & Ziems

[57] ABSTRACT

A feedback control system for controlling the air/fuel ratio of a combustible mixture fed to an internal combustion engine based on the output of an exhaust sensor includes an input circuit of a high input impedance, which serves as a prefatory circuit to a control signal producing circuit to match the high internal impedance of the sensor at low exhaust gas temperatures. The input circuit has an operational amplifier with its noninverting input terminal connected to the sensor and, optionally, two or more switchable resistors to adjust the input impedance.

5 Claims, 5 Drawing Figures

AIR/FUEL RATIO CONTROL SYSTEM FOR INTERNAL COMBUSTION ENGINE HAVING HIGH INPUT IMPEDANCE CIRCUIT

This invention relates to a feedback control system for controlling the air-to-fuel ratio of a combustible mixture fed to an internal combustion engine, which system includes an exhaust sensor for estimating a realized air-to-fuel ratio and a control circuit for providing a control signal based on the magnitude of a deviation of the output of the exhaust sensor from a reference signal, and, more particularly, to an input circuit for transmitting the output of the exhaust sensor to the control circuit.

BACKGROUND OF THE INVENTION

In the field of air pollution prevention attributable to the exhaust gas of internal combustion engines, particularly, for automotive use, it is recognized as important to precisely control the air-to-fuel ratio of a combustible mixture fed to the engines. A feedback control system as one of hitherto proposed techniques employs an exhaust sensor for developing a feedback signal representing a concentration of a certain component (which may be $O_2$, CO, $CO_2$, HC or $NO_x$) of the engine exhaust gas as the indication of the air-to-fuel ratio realized in the engine. In a control circuit of this control system, the output of the exhaust sensor is compared with a reference signal which represents a desirably preset air-to-fuel ratio. Then the control circuit produces a control signal for controlling the operation of an air-fuel proportioning device such as a carburetor or a fuel injection system based on the magnitude of a deviation of the sensor output from the reference signal. The control signal is proportional to the deviation or represents the result of an integration of the deviation, but may comprise both a proportional component and an integral component. In response to this control signal, the fuel feed rate and/or the air feed rate in the air-fuel proportioning device is minutely regulated, along with the usual regulation according to variations in principal factors in the engine operation typified by the degree of opening of the throttle valve, in order to maintain the air/fuel ratio at a preset ratio. The value of the preset ratio is determined so that an exhaust gas treatment apparatus such as a thermal reactor or a catalytic converter included in the exhaust system may work at optimum efficiency. For example, the preset ratio is at or in the vicinity of the stoichiometric air/fuel ratio when a catalytic converter contains a "three-way" catalyst which can catalyze both the reduction of nitrogen oxides and the oxidation of carbon monoxide and hydrocarbons.

In general, currently available exhaust sensors have a considerable high internal impedance which varies as the temperature varies. At present, the most familiar exhaust sensor is an oxygen sensor which operates on the principle of a concentration cell and has as an essential component a layer of an oxygen ion conductive solid electrolyte typified by zirconia stabilized with calcia. The internal impedance of this type of oxygen sensor is on the order of 100 kΩ at about 500° C but rises to the order of 1 MΩ or above at a lower temperature of 200°-300° C.

To precisely detect the output of an exhaust sensor which exhibits a great variation in its internal impedance, an input circuit as part of the control circuit of the above described control system must have a very high impedance, on the order of 10 MΩ.

In conventional control circuits, a familiar input circuit is constructed by the use of a transistor or a field-effect transistor as a principal element. The input impedance of this type of circuit is determined by the impedance characteristic of the employed transistor and, accordingly, can hardly be made above several megohms. It is difficult, therefore, to precisely detect the output of the exhaust sensor while the sensor is exposed to an exhaust gas stream of relatively low temperatures as experiences immediately after starting of the engine or during a continued idling of the engine. From this reason, the operation of the air/fuel ratio control system is usually interrupted while the exhaust gas temperature is not sufficiently high.

SUMMARY OF THE INVENTION

It is an object of the present invention to provide an improved air/fuel control system which is fundamentally of the described type but includes an input circuit having an inherently high input impedance as a prefatory circuit to the control circuit, so that the output of the exhaust sensor can accurately be detected even when the exhaust gas temperature is so low as to render the internal impedance of the sensor above 1 MΩ.

A feedback air-to-fuel ratio control system according to the invention, including an electrically controllable air-fuel proportioning device, an exhaust sensor and a control circuit of the above described types, is characterized by a high input impedance input circuit as a prefatory circuit to the control circuit, which input circuit comprises an operational amplifier with its noninverting input terminal connected to the output terminal of the exhaust sensor.

The negative feedback of the operational amplifier may be controlled in such a manner that the input circuit provides an output voltage substantially of the same magnitude as the output voltage of the exhaust sensor. When, however, the negative feedback is achieved through a resistor and the inverting input terminal of the operational amplifier is grounded through another resistor, the input circuit can provide an output voltage by amplifying the output voltage of the sensor with a gain determined by the resistances of the two resistors.

The input circuit according to the invention has, in principle, an infinitely high input impedance. However, the input circuit is preferably made to have a somewhat lower and variable input impedance to minimize the influence of noises on the control circuit function by providing two or more resistors different from one another in resistance and a switching means for grounding the noninverting input terminal of the operational amplifier selectively through at least one of these resistors, without breaking the connection of this input terminal with the sensor, depending on the exhaust gas temperature and hence the internal impedance of the exhaust sensor.

It is possible to utilize the described operational amplifier also as a comparator the output of which represents a difference between a reference voltage and the output of the exhaust sensor.

DETAILED DESCRIPTION

Figure 1:
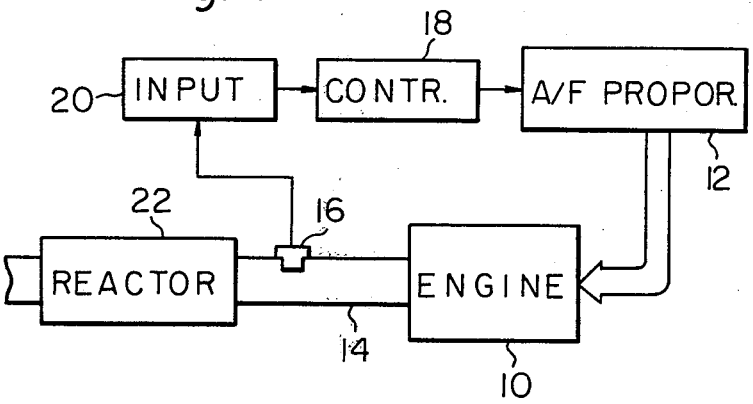
FIG. 1 is a block diagram showing a general construction of a feedback control system according to the invention for controlling the air-to-fuel ratio of a combustible mixture fed to an internal combustion engine.

In connection with an internal combustion engine indicated at 10 in FIG. 1, an air-to-fuel ratio control system according to the invention includes an electrically controllable air-fuel proportioning device 12 such as a carburetor or a fuel injection system, an exhaust sensor 16 installed in exhaust line 14 of the engine 10, and a combination of a control circuit 18 and an input circuit 20. The exhaust sensor 16, usually an oxygen sensor of the concentration cell type using a solid electrolyte, provides a voltage signal from which the air-to-fuel ratio of an air-fuel mixture supplied from the air-fuel proportioning device 12 can be estimated. As will hereinafter be described, the input circuit 20 has a sufficiently high input impedance, can accurately detect the voltage signal supplied from the sensor 16, and transmit the detected signal to the control circuit 18. In practice, the input circuit 20 may be integrated with the control circuit 18. Based on the magnitude of a deviation of the voltage signal developed by the sensor 16 from a reference voltage, the control circuit 18 produces a control signal for controlling the operation of the air-fuel proportioning device 12. Apart from the hereinafter described construction of the input circuit 20, this feedback air-to-fuel ratio control system is similar to the hereinbefore described conventional control system. This control system is usually designed to maintain the air-to-fuel ratio precisely at a preset ratio which is optimum with respect to the function of an exhaust gas treating apparatus 22 such as a thermal reactor or a catalytic converter included in the exhaust line 14 downstream of the exhaust sensor 16.

Figure 2:
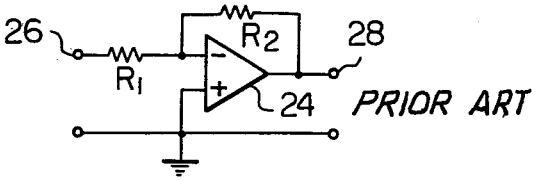
FIG. 2 is a circuit diagram of a prior art an input circuit not in accordance with the invention.

FIG. 2 shows a fundamental construction of an inverting amplification circuit, known in the prior art, which employs an operational amplifier 24 as its principal component but it is not useful as an input circuit according to the present invention. In this circuit, an input terminal 26 is connected to the inverting input terminal (negative input terminal) of the operational amplifier 24 through a resistor having a resistance $R_1$. Negative feedback is afforded to the operational amplifier through a resistor having a resistance $R_2$. The output terminal of the circuit is indicated at 28. The input impedance of this circuit agrees with the resistance $R_1$, while the amplification gain is proportional to the resistance ratio $R_2/R_1$. To maintain a practical gain level with a considerable high input impedance, the resistance $R_2$ must have a very large value. For example, $R_2$ must be on the order of $10^1$–$10^2$ MΩ when the input impedance or resistance $R_1$ is required to be 10 MΩ so as to match with a high level internal impedance of the hereinbefore described oxygen sensor. Such a high resistance $R_2$ for the negative feedback line is impractical, so that the circuit of FIG. 2 is not useful as an input circuit for the control circuit 18 in FIG. 1.

Figure 3:
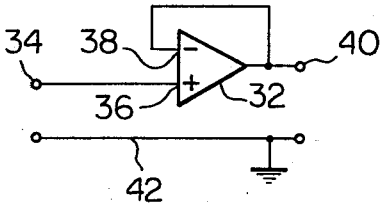
PRIOR ART Fig. 3
FIG. 3 is a circuit diagram showing a fundamental construction of an input circuit according to the invention.

FIG. 3 shows a fundamental construction of a noninverting voltage buffer circuit which serves as the input circuit 20 in FIG. 1 according to the invention. This circuit has a conventional operational amplifier 32 as its principal component. An input terminal 34 of the circuit, to which the output voltage of the exhaust sensor 16 is applied, is directly connected to the noninverting (positive) input terminal 36 of the operational amplifier 32. This input circuit 20 is connected at its output terminal 40 to the control circuit 18. The noninverting input terminal 36 is not directly connected to a ground line indicated at 42 for this input circuit 20. As seen from the illustrated construction, the circuit of FIG. 3 has an infinitely high input impedance and, hence, is quite suitable for the use as the input circuit 20 in FIG. 1. The output magnitude of this circuit is approximately the same as the input, i.e., the output of the exhaust sensor 16. This circuit functions merely as an impedance transformer.

Figure 4:
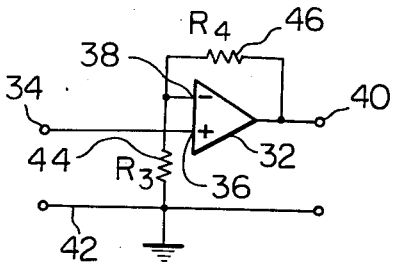
FIG. 4 is a circuit diagram showing a modification of the circuit of FIG. 3 to provide the input circuit with an amplifying ability.

Also a noninverting amplification circuit shown in FIG. 4 can serve as the input circuit 20 according to the invention. The input terminal 34 of this circuit is directly connected to the noninverting (positive) input terminal 36 of the operational amplifier 32. Negative feedback for the operational amplifier 32 is achieved through a resistor 46 having resistance $R_4$. The inverting (negative) input terminal 38 of the operational amplifier 32 is connected to the ground line 42 through a resistor 44 having a resistance $R_3$. This circuit functions as an amplifier with a gain determined by the resistance ratio $(R_3 + R_4)/R_3$.

Figure 5:
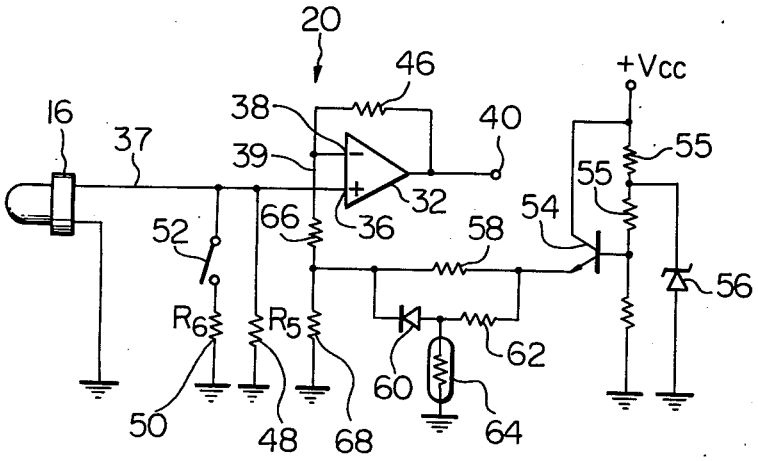
FIG. 5 is a circuit diagram of an input circuit in the control system of FIG. 1 as a preferred embodiment of the invention.

FIG. 5 shows a practical input circuit 20 which is based on the circuit of FIG. 4 and is a preferred embodiment of the invention. The output terminal of the exhaust sensor 16 is applied to the noninverting input terminal 36 of the operational amplifier 32 through an input line 37, and the output terminal 40 of the input circuit 20 is connected to the control circuit 18 in FIG. 1. The input line 37 is grounded through a resistor 48 having a high resistance $R_5$ of, for example, 10 MΩ. Another ground line including, in series, a resistor 50 having a resistance $R_6$ of, for example, 1 MΩ which is lower than the resistance $R_5$ and a normally open switch 52 is connected to the input line 37 in parallel with the ground line including the resistor 48. The switch 52 is automatically closed when the exhaust gas temperature is above a predetermined temperature. For example, the switch 52 function may be achieved by using a pair of relay contacts (not shown) which is operated by a power signal produced in response to a change in the engine temperature.

The two ground lines respectively having the resistances $R_5$ and $R_6$ are connected to the noninverting input terminal 36 to provide the input circuit 20 with an input impedance of an appropriate level. If these ground lines are not present as in the circuit of FIG. 4, the input circuit 20 has practically infinite input impedance and accordingly, is liable to pick up and respond to noises. The values of the resistances $R_5$ and $R_6$ are determined on the basis of the temperature dependency of the internal impedance of the exhaust sensor 16. The input impedance of the input circuit 20 agrees with the high resistance $R_5$ when the exhaust gas temperature is below the predetermined temperature and, accordingly, the internal impedance of the exhaust sensor 16 is very high. When the exhaust gas temperature is above the predetermined temperature and the exhaust sensor 16 exhibits a relatively low internal impedance, for example, on the order of $10^2$ KΩ; the input impedance of the input circuit 20 is a lower value determined by the equation $(R_5 \times R_6)/(R_5 + R_6)$ (approximately 1 MΩ if $R_5$ is 10 MΩ and $R_6$ is 1 MΩ), since the switch 52 is closed. The operational amplifier 32 therefore, can effectively be protected against the introduction of noises thereto.

As seen from the foregoing description, the input circuit 20 according to the invention can inherently provide a very high input impedance to the control circuit 18 and accurately transmit the output of the exhaust sensor 16 even when the exhaust gas temperature is comparatively low. Accordingly, the control circuit can be kept in operation during cold starting of the engine 10 or during continued idling with little fear of erroneous functioning. In addition, the input impedance of the circuit 20 can selectively provide two or more different values to best match it with the variable internal impedance of the exhaust sensor 16 by providing a plurality of resistors (as represented by the resistors 48 and 50 in FIG. 5) and a switching means, so that the control circuit 18 is protected against malfunctions attributable to noise pickup.

It is permissible to use the operational amplifier 32 in the manner as shown in FIG. 3 for constructing the input circuit 20 if the operational amplifier 32 needs not to serve as a voltage amplifier or a comparator.

The operational amplifier 32 in the circuit of FIG. 5 functions also as a deviation detection circuit. When a reference voltage is applied to the inverting (negative) input terminal 38 of the operational amplifier 32 through line 39, the output voltage at the output terminal 40 of the input circuit 19 is the difference between the reference voltage and the output of the sensor 16. In the illustrated case, a reference voltage supply section of the input circuit 20 includes a temperature compensation circuit constituted of a transistor 54, a zener diode 56, a resistor 58 through which the emitter of the transistor 54 is connected to the line 39, a path which is in parallel with the resistor 58 and includes a diode 60 connected to the transistor 54 through another resistor 62, and a thermistor 64 through which the junction between the diode 60 and the resistor 58 is grounded. The thermistor 64 is used as a sensor for detecting the engine temperature from, for example, the temperature of cooling water. A positive voltage $V_{cc}$ is applied to the collector of the transistor 54. The application of this voltage $V_{cc}$ to the base of the transistor 54 through two series connected resistors 55 is governed by the zener diode 56 connected to the junction between the two resistors 55 to provide a ground path. As seen, the transistor 54 and the zener diode 55 constitute a constant current circuit, which supplies a constant current to the other portion of the temperature compensation circuit including the resistors 58 and 62, diode 60 and the thermistor 64.

The line 39 is grounded through two series connected resistors 66 and 68. The resistor 58 and the parallel path having the diode 60 and the resistor 62 are connected to the line 39 at the junction between the two resistors 66 and 68. Since the resistance of the thermistor 64 varies as the engine temperature varies, a voltage at the junction between the resistor 62 and the thermistor 64 varies with a variation in the engine temperature. The higher magnitude voltage between this voltage and another voltage at the junction between the resistor 58 and the diode 60 is applied to the junction between the resistors 66 and 68 to determine the reference voltage as the input to the inverting input terminal of the operational amplifier 32. Accordingly the reference voltage remains constant while the former voltage is lower than the latter voltge but continually varies depending on the engine temperature when the reverse voltage relationship holds.

What is claimed is:

1. In a feedback control system for controlling the air-to-fuel ratio of a combustible mixture fed to an internal combustion engine, the system including an electrically controllable air-fuel proportioning device, an exhaust sensor which is installed in the exhaust line of the engine to develop an output voltage representing the concentration of a definite component of the exhaust gas as an indication of an actual air-to-fuel ratio realized in the engine, and a control circuit which provides a control signal to the air-fuel proportioning device based on th magnitude of a deviation of the output voltage the improvement comprising an input circuit, as a prefatory circuit to the control circuit, including an operational amplifier with a noninverting input terminal thereof connected to the output terminal of the exhaust sensor, said input circuit having an input impedance high enough to match with the internal impedance of the exhaust sensor even when said internal impedance rises with a variation in the exhaust gas temperature, two resistors different in resistance, and a switching means for grounding the input line connecting said noninverting input terminal to the output terminal of the exhaust sensor selectively through at least one of said two resistors depending on the exhaust gas temperature.

2. A control system as claimed in claim 1, wherein said switch means is responsive to the engine temperature such that said input line is grounded through one of said two resistors having a higher resistance when the engine temperature is below a predetermined temperature but otherwise through both of said two resistors.

3. A control system as claimed in claim 2, wherein the resistance of said two resistors are about 1 megohm and about 10 megohm, respectively, said internal impedance of the exhaust sensor being variable within the range from $10^{-1}$ megohm to $10^1$ megohm.

4. In a feedback control system for controlling the air-to-fuel ratio of a combustible mixture fed to an internal combustion engine, the system including an electrically controllable air-fuel proportioning device, an exhaust sensor which is installed in the exhaust line of the engine to develop an output voltage representing the concentration of a definite component of the exhaust gas as an indication of an actual air-to-fuel ratio realized in the engine, and a control circuit which provides a control signal to the air-fuel proportioning device in response to a variation in the output voltage of the exhaust sensor, the improvement comprising an input circuit as a prefatory circuit to the control circuit, the input circuit including:

an operational amplifier with a noninverting input terminal thereof connected to the output terminal of the exhaust sensor;

a first resistor through which the input line connecting said noninverting input terminal to the output terminal of the exhaust sensor is grounded;

a second resistor which has a smaller resistance than said first resistor and is grounded in parallel with said first resistor;

a temperature responsive switching means for groundng said input line also through said second resistor only when the engine temperature is above a predetermined temperature;

a third resistor through which negative feedback is afforded to said operational amplifier; and series connected fourth and fifth resistors through which the inverting input terminal of said operational amplifier is grounded, so that the output of said input circuit represents the difference between the output voltage of the exhaust sensor and a reference voltage determined by a voltage applied to the junction between said forth and fifth resistors.

5. A control system as claimed in claim 4, wherein said input circuit further comprises a sixth resistor through which the junction between said fourth and fifth resistors is connected to a constant current supply, a path in parallel with said sixth resistor including in series connection a seventh resistor and a diode, and a thermistor through which a junction between said seventh resistor and said diode is grounded, said thermistor being located such that the resistance thereof varies as the engine temperature varies, whereby a higher one of a voltage at a junction between said sixth resistor and said diode and another voltage at a junction between said seventh resistor and said thermistor is applied to said junction between said fourth and fifth resistors.

* * * * *